US006860840B2

(12) United States Patent
Carter

(10) Patent No.: US 6,860,840 B2
(45) Date of Patent: Mar. 1, 2005

(54) EXERCISE MACHINE FOR EXERCISING UPPER BODY PORTIONS

(75) Inventor: Kenneth Carter, Clairmont, CA (US)

(73) Assignee: Tuff Stuff Fitness Equipment, Inc., Pomona, CA (US)

( * ) Notice: Subject to any disclaimer, the term of this patent is extended or adjusted under 35 U.S.C. 154(b) by 0 days.

(21) Appl. No.: 10/058,620

(22) Filed: Jan. 30, 2002

(65) Prior Publication Data

US 2003/0144116 A1 Jul. 31, 2003

(51) Int. Cl.[7] ..... A63B 21/08

(52) U.S. Cl. ..... 482/97; 482/137; 482/138; 482/142; 482/908

(58) Field of Search ..... 482/97, 100, 136–139, 482/142, 908

(56) References Cited

U.S. PATENT DOCUMENTS

| | | | | | |
|---|---|---|---|---|---|
| 4,494,751 | A | | 1/1985 | Schnell | |
| 4,598,907 | A | | 7/1986 | Ross | |
| 5,044,631 | A | * | 9/1991 | Jones | 482/138 |
| 5,044,632 | A | * | 9/1991 | Jones | 482/138 |
| 5,069,447 | A | * | 12/1991 | Snyderman et al. | 482/133 |
| 5,098,361 | A | * | 3/1992 | Danylieko | 482/97 |
| 5,181,896 | A | * | 1/1993 | Jones | 482/97 |
| 5,409,438 | A | * | 4/1995 | Jones et al. | 482/100 |
| 5,437,589 | A | | 8/1995 | Habing | |
| 5,667,464 | A | * | 9/1997 | Simonson | 482/97 |
| 5,762,591 | A | * | 6/1998 | Jones | 482/97 |
| 5,788,614 | A | * | 8/1998 | Simonson | 482/97 |
| 5,810,701 | A | * | 9/1998 | Ellis et al. | 482/136 |
| 5,868,654 | A | | 2/1999 | Norian | |
| 5,906,566 | A | * | 5/1999 | Whitcomb | 482/130 |
| 6,179,757 | B1 | | 1/2001 | Koenig | |
| 6,287,243 | B1 | * | 9/2001 | Isom et al. | 482/142 |
| 6,471,624 | B1 | * | 10/2002 | Voris | 482/142 |

OTHER PUBLICATIONS

CYBEX Commercial Strength Systems product brochure, pp. 34–36, 2000.*

* cited by examiner

*Primary Examiner*—Justine R. Yu
*Assistant Examiner*—Victor K. Hwang
(74) *Attorney, Agent, or Firm*—Edward A. Sokolski

(57) ABSTRACT

An exercise machine has seat and back rest portions which are hinged to each other and independently pivotally supported on a support frame. The seat and the back rest portions are initially in a horizontal position to enable the user to exercise in a lying down position. The seat has an adjuster by means of which it can be angularly lowered to any one of a number of positions with the rear portion lowered more than the front portion. The front portion of the back rest which is hinged to the rear of the seat is lowered along with the seat to bring the back rest to the selected upwardly angulated position. A pair of lever arms are connected together at their inner ends and extend angularly outwardly from each other. Weights are connected to the inner ends and handles are connected to the outer ends for grasping by the user. Height adjusters are provided on the handles and arms to enable adjustment for persons of different sizes.

5 Claims, 2 Drawing Sheets

EXERCISE MACHINE FOR EXERCISING UPPER BODY PORTIONS

BACKGROUND OF THE INVENTION

1. Field of the Invention

This invention relates to exercise machines for exercising the upper body portions and more particularly to such a machine which can be adjusted between horizontal and selected angulated vertical positions.

2. Description of the Related Art

Exercise machines for exercising the upper body by providing handles for the user to push upwardly and downwardly against a weighted load are in general use. Such prior art devices are described in U.S. Pat. No. 6,179,757 issued Jan. 30, 2001 to Koenig and U.S. Pat. No. 5,437,589 issued Aug. 1, 1999 to Habing. Such prior art machines are not adapted to be adjusted from a position at which the seat and back rest are horizontal to one of a number of positions vertically angulated relative to the horizontal. Further, these prior art systems do not show arm operated levers which run angularly inwardly towards each other from the lever handles. The above indicated features of the present invention provides greater versatility in the use of the system and makes for more natural lifting action of the weighted levers.

SUMMARY OF THE INVENTION

The machine of the present invention utilizes a seat and back rest which are hinged to each other calibrated adjustment lever is provided on the seat by means f which the seat can be lowered to one of a number of selected positions with the portion connected to the back rest being lowered more than the front portion. The seat portion carries the lower part of the back rest along with it, bringing the back rest to a preselected angular vertical position. Thus, the machine can be used for a number of different types of exercises merely by a simple adjustment of the seat and back rest.

A pair of opposing lever arms are connected together through a swivel bracket on one end thereof a d supported pivotally on the support frame. The two arms run outwardly from each other at an angle of about 35 degrees. Handles re attached to the other end of the arms which are free. Adjustments are provided to adjust the position of the arms and the eight of the levers to accommodate various size persons.

It is therefore an object of this invention to provide an improved upper body exercise machine i which the positions of the seat and back rest can be readily adjusted to a selected position between horizontal and angulated vertical positions.

It is a further object of this invention to provide an upper body exerciser in which the seat a d back rest can readily be set in any one of a number of different positions.

Other objects of the invention will become apparent in view of the following description taken in connection with the accompanying drawings.

DETAILED DESCRIPTION OF THE INVENTION

Figure 1:
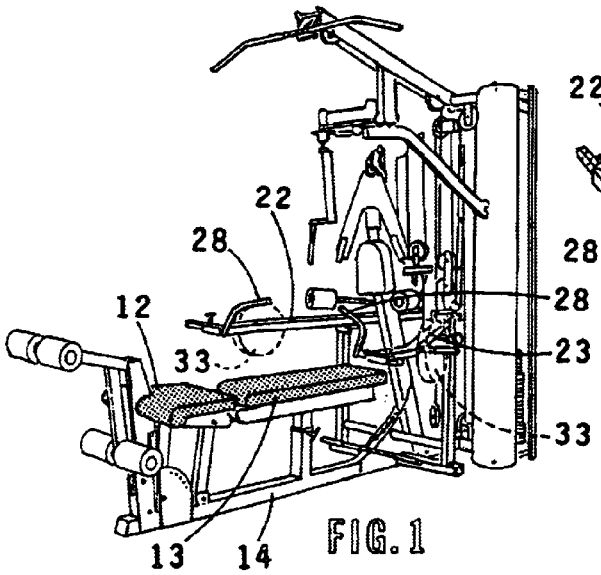
FIG. 1 is a side perspective view of a preferred embodiment of the invention.
Figure 2:
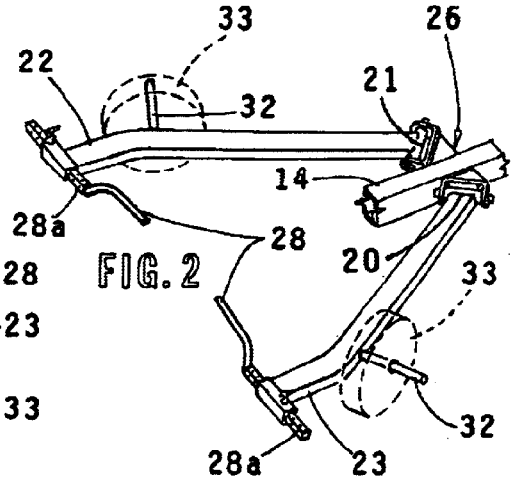
FIG. 2 is a top perspective view of the levers and handles of the preferred embodiment.

Referring now to the FIGS, a preferred embodiment of the invention is illustrated. As can best be seen in FIGS 6–11, seat 12 is pivotally supported on frame 14 by means of support 15 which is adjustable to bring the seat downward to selected positions. This d result is achieved by means of gauge 16 which has an arcuate series of adjustment apertures formed therein. The support includes forward and rear post portions 15*a* and 15*b* interconnected by a horizontal cross piece 15*c* to form a four-bar linkage with the frame 14. Sup 15 has a pin 15*d* which fits into any selected one of these apertures to position the seat and the attached back rest 13 at a desired position between horizontal and down adjacent to the se of frame 14. The back rest is pivotally supported on post 19 which has an adjustment member 19*a* for adjusting its height. The front end of back rest 13 is hinged to the rear of seat 2 and thus moves with the seat with its forward end moving downwardly as the seat is moved downwardly and with its rear end moving upwardly, as shown in the various Figures.

Figure 3:
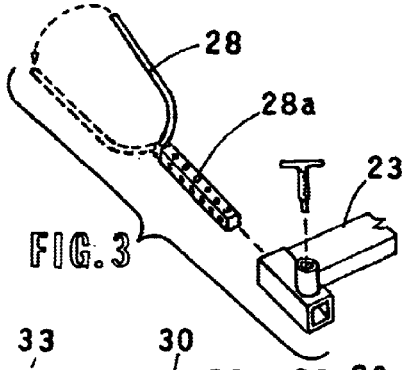
FIG. 3 is a top perspective view illustrating the handle adjustment of the preferred embodiment.
Figure 4:
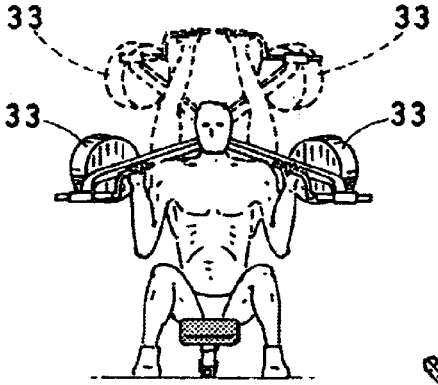
FIG. 4 is a front perspective view illustrating the use of the system of the invention in a seated position.
Figure 5:
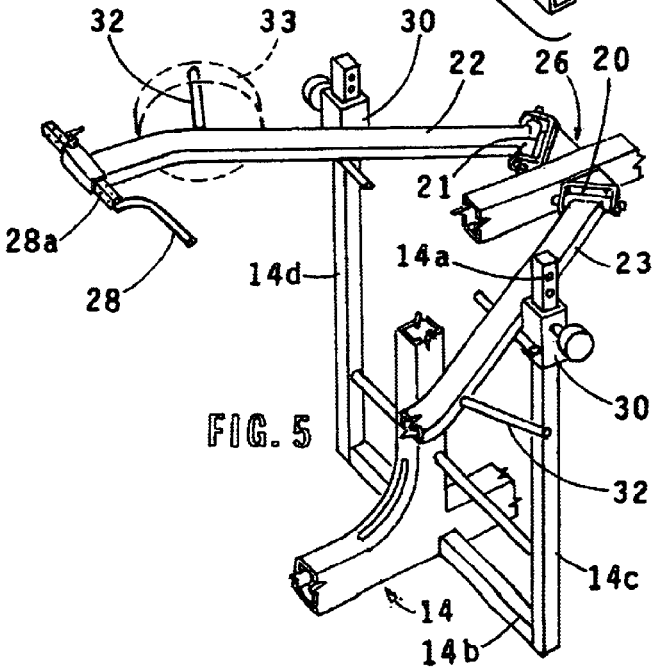
FIG. 5 is a side perspective view illustrating the support of the levers on the frame in the preferred embodiment.

Referring to FIGS. 1–5, the arm exercise mechanism is illustrated. Frame 14 has a base portion 14*b*, side portions 14*c* and 14*d*, and an upper central portion 14*e* which runs normally to base portion 14*b*. Lever arms 22 and 23 are pivotally connected together at one end by swivel bracket assembly 26 which is supported on the upper central portion 14*e* of the frame 14. Swivel bracket assemble 26 comprises swivel brackets 20 and 21 horizontally angulated relative to each other with the pivot axes of the swivel brackets occupying a common plane with the central upper portion 14*e* of the frame 14. The arms extend outwardly away from each other at an angle of about 35 degrees between each arm and a longitudinal axis of the upper central portion 14*e*. Handles 28 are attached to the opposite free ends of the arms for grasping by the user. At a position between the opposite ends of the arms, the arms are pivotally on frame 14 by means of pivotal support 30. Vertical adjustment apertures 14*a* are provided in the frame to permit the height of the arms to be set for persons of different sizes. As shown in FIG. 3, adjustment apertures are provided in the attachment posts 28*a* of handles 28 to accommodate various size persons. In addition, the posts can be rotated 180 degrees to accommodate the situation.

Posts 32 extend outwardly from the sides of the levers for mounting weights 33.

Figure 6:
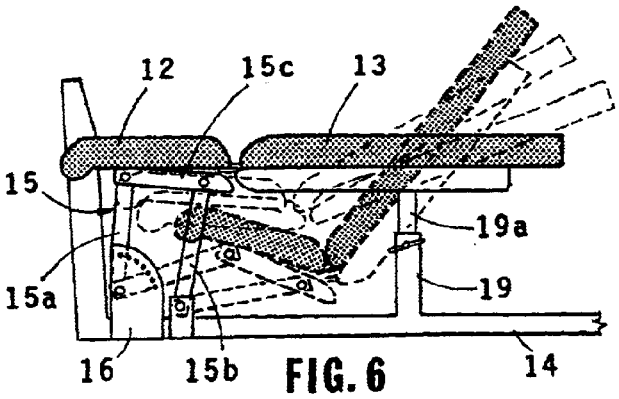
FIG. 6 is a side elevational view of the preferred embodiment showing the moving of the seat from its upper to its lower position.
Figure 7:
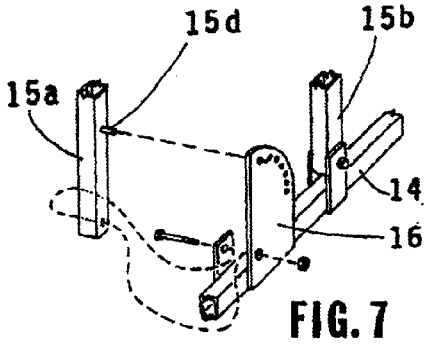
FIG. 7 is a front perspective view illustrating the seat adjustment mechanism of the preferred embodiment.
Figure 8:
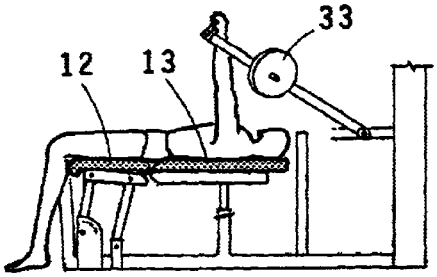
FIG. 8 is an illustration showing the use of the preferred embodiment in a reclining position.
Figure 9:
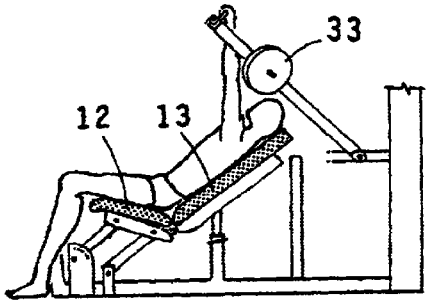
FIG. 9 is an illustration showing the use of the preferred embodiment in a semi reclining position.
Figure 10:
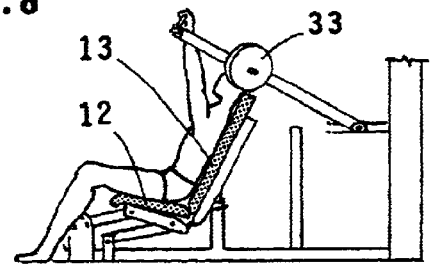
FIG. 10 is an illustration showing the use of the preferred embodiment in a near upright position.
Figure 11:
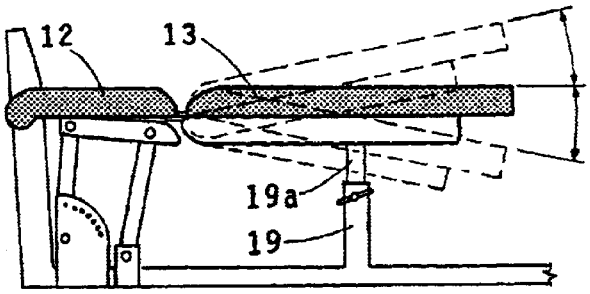
FIG. 11 is a side elevational view showing an adjustment of the fixed position of the back rest in the preferred embodiment.

The user can exercise from a reclined position as shown in FIG. 8, a semi-reclined position, as shown in FIG. 9 or a near upright position as shown in FIG. 10, merely by adjusting the machine to these various positions, as shown in FIG. 6.

While the invention has been described and illustrated in detail, this is intended by way of illustration and example only, the scope of the invention being limited by the terms of the following claims.

I claim:

1. An exercise machine comprising:

a support frame having a base, side portions, and a central upper portion running normal to said base portion;

a seat portion pivotally mounted on said base by a four-bar linkage for setting the seat portion at one of a plurality of pre-selected positions at different distances from said base portion of said support frame, the pre selected positions defined by a gauge having an arcuate series of adjustment apertures;

a back rest portion hinged to said seat portion and hinged to a height adjustment member mounted on said base;

an end of said back rest portion connected to the seat portion so that it can move along with said seat portion to bring said back rest portion towards a vertical position;

a pair of opposing lever arms connected together at one end thereof, said lever arms having supports thereon for supporting weights;

means for pivotally supporting one end of each of said lever arms on said central upper portion of said support frame on opposite sides of said central upper portion with said lever arms extending outwardly from a longitudinal axis of said central upper portion at an angle of approximately 35 degrees;

said lever arms each being supported on a separate swivel bracket, said swivel brackets being horizontally angulated relative to each other and having pivot axes occupying a common plane with said central upper portion of said support frame; and handles mounted on the other ends of said lever arms for use in grasping the lever arms.

2. The exercise machine of claim 1 and further including means for selectively adjusting the resting position of said lever arms above the base portion of the support frame.

3. The exercise machine of claim 1 and further including means for selectively adjusting the positions of said handles relative to said lever arms.

4. The exercise machine of claim 1 wherein said swivel brackets form a swivel bracket assembly, said lever arms being interconnected by said swivel bracket assembly.

5. The exercise machine of claim 1 wherein said handles are removably mounted on said lever arms with a mount permitting adjustment of the position of the handles relative to said lever arms and the axial positioning thereof in one of two positions 180 degrees apart.

* * * * *